US006369020B1

(12) United States Patent
Kohlus et al.

(10) Patent No.: US 6,369,020 B1
(45) Date of Patent: Apr. 9, 2002

(54) GRANULAR DETERGENT COMPONENTS AND PARTICULATE DETERGENT COMPOSITIONS CONTAINING THEM

(75) Inventors: Reinhard Kohlus; Remy Antal Verburgh, both of Vlaardingen (NL); Gilbert Martin Verschelling, Bebington (GB)

(73) Assignee: Unilever Home & Personal Care USA, Greenwich, CT (US)

( * ) Notice: Subject to any disclaimer, the term of this patent is extended or adjusted under 35 U.S.C. 154(b) by 0 days.

(21) Appl. No.: 09/442,401

(22) Filed: Nov. 18, 1999

(30) Foreign Application Priority Data

Nov. 20, 1998 (GB) ..... 9825558

(51) Int. Cl.[7] ..... C11D 17/06; C11D 1/02; C11D 3/12

(52) U.S. Cl. ..... 510/438; 510/276; 510/351; 510/444; 510/495; 510/507; 510/511; 510/498; 510/477

(58) Field of Search ..... 510/276, 438, 510/507, 511, 444, 351, 477, 495, 498

(56) References Cited

U.S. PATENT DOCUMENTS

| | | | | | |
|---|---|---|---|---|---|
| 3,920,586 | A | | 11/1975 | Bonaparte et al. | 252/531 |
| 5,318,733 | A | * | 6/1994 | Carduck et al. | 264/15 |
| 5,494,599 | A | * | 2/1996 | Goovaerts et al. | 510/444 |
| 5,529,715 | A | * | 6/1996 | Kuroda et al. | 510/349 |
| 5,536,432 | A | * | 7/1996 | Cicciari et al. | 510/377 |
| 5,919,747 | A | * | 7/1999 | Kazuta et al. | 510/444 |
| 5,955,418 | A | * | 9/1999 | Kazuta et al. | 510/451 |
| 6,034,050 | A | * | 3/2000 | Artiga Gonzalez et al. | 510/451 |
| 6,159,927 | A | * | 12/2000 | Kandasamy | 510/537 |
| 6,191,095 | B1 | * | 2/2001 | Emery et al. | 510/438 |
| 6,221,831 | B1 | * | 4/2001 | Emery et al. | 510/438 |

FOREIGN PATENT DOCUMENTS

| | | | | |
|---|---|---|---|---|
| CA | 1 211 672 | | | 9/1986 |
| DE | 42 16 775 | A1 | | 11/1993 |
| DE | 42 29 660 | | | 3/1994 |
| DE | 195 24 722 | | | 1/1997 |
| EP | 105 160 | | | 9/1982 |
| EP | 129 276 | A | | 12/1984 |
| EP | 430 603 | A2 | | 6/1991 |
| EP | 651 050 | A | | 5/1995 |
| EP | 0 688 861 | A1 | | 12/1995 |
| WO | 95/02036 | | | 1/1995 |
| WO | 95/24461 | | * | 9/1995 |
| WO | 96/0616 | A | | 3/1996 |
| WO | 96/0617 | A | | 3/1996 |
| WO | 97/10321 | | | 3/1997 |
| WO | 97/32002 | A | | 9/1997 |
| WO | 97/32005 | A | | 9/1997 |
| WO | 97/33957 | | | 9/1997 |
| WO | 98/14557 | | * | 4/1998 |
| WO | 98/54278 | | | 12/1998 |
| WO | 98/54281 | A | | 12/1998 |

* cited by examiner

*Primary Examiner*—Lorna M. Douyon
(74) *Attorney, Agent, or Firm*—Rimma Mitelman

(57) ABSTRACT

A free-flowing granular detergent component comprises a high level (at least 30 wt %) of a heat-sensitive surfactant, preferably an alkyl ether sulphate; a water-insoluble silica or silicate carrier material of high oil absorption capacity; and a film-forming or crystal-forming structurant. The granular component may be used in conjunction with one or more other granular components containing surfactant and/or detergency builder, to form a particulate laundry detergent composition. The granular component is preferably prepared by mixing and granulation in a high- or moderate-shear mixer and drying in a fluidized bed.

6 Claims, No Drawings

GRANULAR DETERGENT COMPONENTS AND PARTICULATE DETERGENT COMPOSITIONS CONTAINING THEM

TECHNICAL FIELD

The present invention relates to granular detergent components containing heat-sensitive surfactants, especially alkyl ether sulphates, and particulate laundry detergent compositions containing them.

BACKGROUND AND PRIOR ART

Alkyl ether sulphates (alkyl polyethoxy sulphates) are desirable ingredients for laundry detergent compositions. They are relatively insensitive to calcium ions and are frequently used in combination with more calcium-sensitive anionic surfactants such as linear alkylbenzene sulphonates as a supplementary surfactant or "coactive".

However, alkyl ether sulphates cannot be processed at elevated temperatures because of a tendency to decompose significantly at temperatures higher than 80° C. They are not, therefore, generally incorporated into spray-dried laundry powders via the slurry.

Similar considerations apply to other heat-sensitive surfactants (anionic, cationic, amphoteric or zwitterionic) that are usefully incorporated into laundry detergent compositions.

It is therefore desirable to incorporate these surfactants as a separate granular component in which the surfactant is carried on a suitable carrier material.

Highly effective methods of producing free-flowing granular detergent components containing high levels of anionic surfactants (for example, alkylbenzene sulphonates) are disclosed in WO 96/06916A, WO 96/06917A, WO 97/32002A and WO 97 32005A (Unilever). However, these processes involve flash drying of aqueous pastes at temperatures above 130° C., and are therefore unsuitable for processing alkyl ether sulphates and other heat-sensitive surfactants.

It has now been found that stable free-flowing granules containing high loadings of heat-sensitive anionic, cationic, amphoteric or zwitterionic surfactants can be prepared using a carrier comprising a highly oil-absorbent silica or silicate, and a defined structurant.

WO 98 54281A (Unilever), published on Dec. 3 1998, discloses granular detergent components containing high levels of nonionic surfactants. These granules utilise as carrier material a silica having a high oil absorption capacity. In addition to the nonionic surfactant, the granules may contain up to 5 wt % of anionic surfactant.

EP 430 603A (Unilever) discloses detergent granules containing at least 30 wt % anionic surfactant and containing a highly oil-absorbent filler, for example, a silica, in intimate contact with the anionic surfactant.

WO 97 10321A (Procter & Gamble) discloses structured surfactant compositions comprising 35–60 wt % surfactant, preferably alkyl ether sulphate, 1–20 wt % hydrophilic finely-divided silica and 15–25 wt % moisture; these compositions are in the form of a "hardened continuous paste".

EP 105 160A (Akzo) discloses silicas loaded with aqueous surfactant solutions, preferably primary alcohol sulphate, alkyl ether sulphate or nonionic surfactant, for use in toothpastes; the highest surfactant loading disclosed in in a free-flowing granule is 20 wt %, higher loadings being detrimental to flow.

EP 651 050A (Procter & Gamble) discloses detergent agglomerates comprising a solid, preferably water-soluble, salt (for example, sodium silicate, carbonate or sulphate), and a fluid binder comprising an anionic surfactant (preferably alkyl ether sulphate) and sodium silicate.

DEFINITION OF THE INVENTION

A first subject of the present invention is a free-flowing granular detergent component comprising (a1) at least 30 wt %, preferably 30 to 75 wt %, of a heat-sensitive anionic, cationic, amphoteric or zwitterionic detergent surfactant, (a2) from 15 to 50 wt % of a water-insoluble carrier material comprising a silica or silicate having an oil absorption capacity of at least 1.0 ml/g, (a3) from 2 to 15% by weight of a structurant which is a water-soluble material capable of drying from aqueous solution and/or solidifying from the melt to form a crystalline and/or amorphous film.

The invention also provides a process for preparing the granular detergent compound, as described in more detail below.

A further subject of the invention is a particulate detergent composition composed of at least two different granular components:

(a) a granular component as defined above, (b) at least one other granular component selected from (b1) a detergent base powder composed of structured particles comprising anionic surfactant, builder, optionally nonionic surfactant and optionally other detergent ingredients, (b2) a builder granule, and (b3) a granule containing at least 40 wt % of alkylbenzene sulphonate and/or primary alcohol sulphate, (b4) a granule containing at least 20 wt % of nonionic surfactant.

The Granular Detergent Component

The granular detergent component comprises at least 30 wt %, and preferably from 30 to 75 wt %, more preferably from 40 to 75 wt %, of the heat-sensitive surfactant.

The heat-sensitive surfactant may be anionic, cationic, amphoteric or zwitterionic. For the purposes of the present specification a surfactant is "heat-sensitive", if it undergoes significant decomposition at temperatures above 80° C.

Preferred heat-sensitive anionic surfactants are alkyl ether sulphates.

The granule also contains from 15% to 50 wt % of by weight of a silica or silicate carrier material having an oil absorption capacity of at least 1.0 ml/g. Oil absorption capacity is a parameter which is well known and can be measured by the technique described in DIN ISO 787/5. Preferably, the oil absorption capacity is at least 1.5 ml/g, more preferably at least 2.0 ml/g.

Preferably, the granule contains at least 20% of the silica or silicate carrier material.

The silica or silicate carrier material is preferably selected from silicas, magnesium silicate, calcium silicate, and amorphous alkali metal aluminosilicates.

Silicas and silicates having the required oil absorption capacity are commercially available, for example:

| | Material | Supplier | LCC (ml/g) |
|---|---|---|---|
| Sorbosil TC-15 | Silica | Crosfield | 2.8 |
| Hubersorb 600 | Calcium silicate | Huber | 4.8 |
| Sipernat D17 | Silica | Degussa | 2.3 |
| Sipernat 50 | Silica | Degussa | 3.3 |
| Aerosil 380 | Silica | Degussa | 3.5 |
| Zeosyl 200 | Silica | Huber | 2.6 |

Optionally, the granule may also contain a crystalline alkali metal aluminosilicate (zeolite). The amount of zeolite present may suitably range from 2 to 20 wt %, preferably from 5 to 15 wt %.

The zeolite which may be used in the nonionic-surfactant-containing granules of the present invention may be the commercially available zeolite A (zeolite 4A) now widely used in laundry detergent powders. This is commercially available, for example, as Wessalith (Trade Mark) P from Degussa AG.

Alternatively, maximum aluminium zeolite P (zeolite MAP) as described and claimed in EP 384 070B (Unilever), and commercially available as Doucil (Trade Mark) MAP from Crosfield Chemicals Ltd, UK, may be used. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Zeolites have a substantially lower liquid carrying capacity than do the silicas or silicates which are the principal carriers in the granules of the invention. For example, the liquid carrying capacity of zeolite MAP is 0.6 ml/g.

The granules of the present invention also contain a structurant, which may also be considered as a binder, in order to improve the strength and flow of the granules. The structurant, present in an amount of from from 2 to 15 wt %, is a material capable of drying from aqueous solution and/or solidifying from the melt to form a crystalline and/or amorphous film.

The granular detergent component may, for example, comprise as structurant a water-soluble film-forming material selected from soaps, sugars, water-soluble polymers, alkali metal silicates and combinations thereof. Preferred examples include glucose, maltose, ethylene glycol homo- and copolymers, polyvinyl alcohols (preferably of molecular weight 30,000 to 200,000), polyacrylates (preferably of molecular weight 30,000 to 200,000), and acrylic/maleic copolymers (eg Sokalan (Trade Mark) CP5 ex BASF).

Alternatively or additionally, the granular detergent component may comprise as structurant (a3) a crystal-forming material selected from water-soluble solid organic acids and their water-soluble salts, water-soluble alkali metal salts, and combinations thereof.

Preferred structurants are selected from citric acid and its water-soluble salts, succinic acid and its water soluble salts, water-soluble inorganic sulphates, carbonates and chlorides, and combinations thereof.

Especially preferred structurants are selected from citric acid, sodium citrate, sodium sulphate, sodium carbonate, acrylate/maleate copolymer, glucose, polyvinyl alcohol, and combinations thereof.

Structurants applied from the melt should have a melting point not substantially lower than the wet bulb temperature of the drying powder, otherwise agglomeration will occur on drying. Examples of suitable materials include polyethylene/propylene glycol of molecular weight 1000 to 12,000, eg PEG 1500 and PEG 4000.

In the granular component of the invention, other minor ingredients such as water may be present. The water content preferably does not exceed 10% by weight, as measured by the Karl Fischer method.

The granular detergent components of the present invention preferably have a bulk density in the range of from 400 to 800 g/l. The granule sizes are preferably in the range of from 200 to 1000 micrometers.

Preparation of the Granular Detergent Component

The granules may be manufactured by any suitable method provided that the granule temperature does not exceed 80° C., and preferably does not exceed 70° C., for any significant period of time during the process. The drying temperature (air temperature) may of course be higher, especially during stages of the process when there is sufficient water present to provide cooling by evaporation, so that the granule temperature is the wet bulb temperature rather than the air temperature.

Preferably, the components are granulated together in a mechanical mixer, more preferably a high-shear mixer.

Preferably, a high-speed mixer/densifier or granulator is used.

Alkyl ether sulphate is commercially available in the form of an aqueous paste, having an active matter content of 70%. This starting material may be used to prepare granular components according to the invention, as follows.

The paste is mixed with the silica or silicate carrier material and any zeolite to be incorporated, in a high-shear mixer. The amount of alkyl ether sulphate paste used desirably is no more than 95% of the liquid carrying capacity of the silica or silicate carrier. This first step produces as an intermediate product a very fine, dry powder.

After a short period of mixing, structurant solution (or molten structurant) is introduced and the mixture granulated. Granulation times may typically range from 10 seconds to 5 minutes.

Examples of suitable high-shear mixers include the Eirich RVO2 Granulator (high shear), and the Lödige ploughshare mixer (moderate shear). If desired different mixers may be used for the two stages (high shear followed by moderate shear, or vice versa).

The resulting granulate must subsequently be dried. Preferably drying is effected using a convective method, for example, a fluidised bed. Without wishing to be bound by theory, it is believed that during the drying stage the structurant forms a crust (incomplete coating) which brings granule strength, helps to prevent liquid from bleeding out from the granules, and acts as a barrier to keep out moisture. This last function is especially beneficial for alkyl ether sulphates which are very hygroscopic.

During the drying stage, as in earlier stages, it is important to take care that that the granule temperature does not exceed 70° C., even though the drying temperature may be higher, especially in the early stages of drying when evaporative cooling operates to keep the granule temperature at the wet bulb temperature. Care should be taken when most of the water has been driven off that the temperature does not rise sufficiently to cause significant decomposition.

Accordingly, a preferred process for the preparation of a granular detergent component of the invention comprises the steps of:

(i) mixing the heat-sensitive surfactant in aqueous paste form, the silica or silicate carrier material and (if present) zeolite in a high- or moderate shear mixer, (ii) introducing the structurant in solution or melt form into the mixer and granulating in a high- or moderate shear mixer, (iii) drying the resulting granular product by a convective method, preferably a fluidised bed, wherein the granule temperature does not exceed 70° C.

Detergent Compositions

As indicated previously, a further subject of the invention is a particulate detergent composition in which the granular detergent component of the invention is present in admixture with at least one, and preferably at least two, other granular components comprising surfactant and/or builder, selected from the following list:

(b1) a detergent base powder composed of structured particles comprising anionic surfactant, builder, optionally nonionic surfactant and optionally other detergent ingredients, (b2) a builder granule, and (b3) a granule containing at least 40 wt %, advantageously at least 60 wt %, of alkylbenzene sulphonate and/or primary alcohol sulphate, (b4) a granule containing at least 20 wt %, advantageously at least 55 wt %, of nonionic surfactant.

Preferably the detergent composition contains from 2 to 50 wt % of the granular component containing the heat-sensitive surfactant, and from 50 to 98 wt % of one or more other granular components (b1–b 4).

The granular components of the invention can be mixed with conventional surfactant-containing base powders in order to increase the surfactant content of the overall composition.

Alternatively the components may be used in conjunction with other granular components in which surfactants and builders are separated out. For example, the final composition may contain, as well as the granular component of the invention, a granule containing a high loading of alkylbenzene sulphonate or primary alcohol sulphate, a granule containing a high loading of nonionic surfactant, and a builder granule.

Between these two extremes of a "conventional" and a "modular" powder various compromise compositions can also be envisaged.

Preferred "modular" compositions contain at least three different granules comprising surfactant and/or builder.

Base powders and builder granules may be manufactured by any suitable process. For example, they may be produced by spray-drying, by spray-drying followed by densification in a batch or continuous high speed mixer/densifier, or by a wholly non-tower route comprising granulation of components in a mixer/densifier, preferably in a low shear mixer/densifier such as a pan granulator or fluidised bed mixer.

Granules of high bulk density containing high levels (at least 60 wt %) of alkylbenzene sulphonate or primary alcohol sulphate may be prepared by the flash-drying method mentioned previously and disclosed in WO 96/00916A, WO 96/06917A, WO 97/32002A and WO 97 32005A (Unilever).

Granules of lower bulk density containing at least 40 wt % of alkylbenzene sulphonate are described and claimed in our copending international patent application of even date claiming the priority of British Patent Application No. 98 25563.1 filed on Nov. 20, 1998.

Granules containing high levels (at least 55 wt %) of nonionic surfactant may be as described in WO 98 54281A (Unilever) published on Dec. 3, 1998. These granules employ a silica or silicate carrier. Alternatively granules containing at least 20 wt % of nonionic surfactant and utilising a fast-dissolving water-soluble carrier material, as described and claimed in our copending international patent application of even date claiming the priority of British Patent Application No. 98 25560.7 filed on Nov. 20, 1998, may be used.

The separately produced granular components may be dry-mixed together in any suitable apparatus.

Further ingredients (for example bleach, perfume) may subsequently be sprayed onto or admixed with (postdosed to) the mixture of granular components. Preferably, the totality of the specified granular components provides at least 40% by weight, preferably at least 50% by weight of the final composition, the remaining less than 60%, preferably less than 50% by weight, if present, being constituted by postdosed or sprayed-on ingredients.

Suitable ingredients which may be postdosed to the mixture of granular components will be discussed further below.

The individual granular components may be of any suitable bulk density.

Detergent Ingredients

The finished detergent composition, whether containing a base powder or a number of different granules, will contain detergent ingredients as follows.

As previously indicated, the detergent compositions will contain, as essential ingredients, one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Amphoteric surfactants, for example, amine oxides, and zwitterionic surfactants, for example, betaines, may also he present.

Preferably, the quantity of anionic surfactant is in the range of from 5 to 50% by weight of the total composition. More preferably, the quantity of anionic surfactant is in the range of from 8 to 35% by weight.

Nonionic surfactant, if present, is preferably used in an amount within the range of from 1 to 20% by weight.

The total amount of surfactant present is preferably within the range of from 5 to 60 wt %.

The total amount of alkyl ether sulphate or other heat-sensitive surfactant present may suitably range from 1 to 20 wt %, preferably from 1.5 to 15 wt % and more preferably from 2 to 10 wt %.

The compositions may suitably contain from 10 to 80%, preferably from 15 to 70% by weight, of detergency builder. Preferably, the quantity of builder is in the range of from 15 to 50% by weight.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Crosfield Chemicals Ltd, UK. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxy-methyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Builders are normally wholly or predominantly included in the granular components, either in the base powder or in a separate builder granule.

Detergent compositions according to the invention may also suitably contain a bleach system. It is preferred that the compositions of the invention contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. Bleach ingredients are generally post-dosed as powders.

The peroxy bleach compound, for example sodium percarbonate, is suitably present in an amount of from 5 to 35 wt %, preferably from 10 to 25 wt %. The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), ethylenediamine disuccinate (EDDS), and the aminopolyphosphonates such as ethylenediamine tetramethylene phosphonate (EDTMP) and diethylenetriamine pentamethylene phosphonate (DETPMP).

The detergent compositions may also contain one or more enzymes. Suitable enzymes include the proteases, amylases, cellulases, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as "Carezyme").

Detergency enzymes are commonly employed in granular form in amounts of from about 0.1 to about 3.0 wt %. However, any suitable physical form of enzyme may be used.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokalan (Trade Mark) HP22. Especially preferred soil release polymers are the sulphonated non-end-capped polyesters described and claimed in WO 95 32997A (Rhodia Chimie).

The compositions of the invention may also contain dye transfer inhibiting polymers, for example, polyvinyl pyrrolidone (PVP), vinyl pyrrolidone copolymers such as PVP/PVI, polyamine-N-oxides, PVP-NO etc.

The compositions of the invention may also contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention. Sodium carbonate may be included in granular components, or post-dosed, or both.

The detergent composition may contain water-soluble alkali metal silicate, preferably sodium silicate having a $SiO_2$:$Na_2O$ mole ratio within the range of from 1.6:1 to 4:1.

The water-soluble silicate may be present in an amount of from 1 to 20 wt %, preferably 3 to 15 wt % and more preferably 5 to 10 wt %, based on the aluminosilicate (anhydrous basis).

Other materials that may be present in detergent compositions of the invention include fluorescers; photobleaches; inorganic salts such as sodium sulphate; foam control agents or foam boosters as appropriate; dyes; coloured speckles; perfumes; and fabric conditioning compounds.

Ingredients which are normally but not exclusively postdosed, may include bleach ingredients, bleach precursor, bleach catalyst, bleach stabiliser, photobleaches, alkali metal carbonate, water-soluble crystalline or amorphous alkaline metal silicate, layered silicates, anti-redeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

EXAMPLES

The present invention will be further illustrated by the following non-limiting Examples.

Except where stated otherwise, all quantities are in parts or percentages by weight.

In the following examples, the following test methods will be used:

Dynamic Flow Rate (DFR)

The dynamic flow-rate or DFR is measured by the following method. The apparatus used consists of a cylindrical glass tube having an internal diameter of 35 mm and a length of 600 mm. The tube is securely champed in a position such that its longitudinal axis is vertical.

Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow-rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR=V/t$$

The averaging and calculation are carried out electronically and a direct read-out of the DFR value obtained.

Solubility Measurement 5 g of the powder under investigation is dosed into 500 ml of water contained in 1000 ml beaker at a temperature of 20° C. The water is stirred with a magnetic stirring rod of 6 cm maintaining a 4 cm vortex for 2 minutes after which the solution is poured over a filter with a mesh size of 125 $\mu$m. The filter with residue is dried at 80° C. in an oven for an hour after which the amount of residue is weighed. The amount of insolubles is calculated by:

$$\text{Insolubles } [\%] = \frac{\text{Amount of residue } [g]}{\text{Amount of initial powder } [g]} \times 100\%$$

Rate of Dissolution

A 1.25 g sample of the granules is dissolved in 500 ml of water with stirring, and the conductivity of the solution as a function of time is recorded. The test is continued until the conductivity has reached a constant value. The measure for the rate of dissolution is taken to be $t_{90}$, the time (in seconds) taken to reach 90% of the final conductivity value.

Examples 1 to 8, Comparative Example A

Granular Detergent Components

Granular detergent components containing the following carrier materials were prepared:

| | | |
|---|---|---|
| Sorbosil TC 15 | Crosfield | Silica |
| Wessalith P | Degussa | Zeolite |
| Hubersorb 600 | Huber | Calcium silicate |

The following structurants were used (all aqueous solutions):

30% sodium citrate solution

50% citric acid solution

20% sodium sulphate solution

20% sodium carbonate solution

40% acrylate/maleate copolymer solution (Sokalan (Trade Mark) CP5 ex BASF)

Granular products were prepared by mixing 70% alkyl ether sulphate (AES) paste ($C_{13}$–$C_{15}$ alkyl 3EO sulphate, Manro (Trade Mark) BES70 ex Manro) with solid carriers, for 10 seconds, in a Moulinette kitchen mixer. Subsequently, structurant solution was added in the amount specified, and granulation was carried out for 5–10 seconds.

The resulting granular products were dried in an Aeromatic Strea-1 fluidised bed, for 30 minutes. Examples 1 to 8 were dried at an air temperature of 70° C., while Comparative Example A was dried at an air temperature of 80° C.

| Ingredients (g) | 1 | A | 2 | 3 | 4 | 5 | 6 | 7 | 8 |
|---|---|---|---|---|---|---|---|---|---|
| 70% AES paste | 75 | 75 | 70 | 70 | 70 | 64 | 65 | 80 | 75 |
| Sorbosil TC 15 | 25 | 25 | 25 | 25 | 20 | 22 | 22 | | |
| Wessalith P | | | | | 10 | | | | |
| Hubersorb 600 | | | | | | | | 20 | 20 |
| Sodium citrate | 10 | 10 | 15 | | | | | | |
| Citric acid | | | | 10 | 5 | | | | |
| Sodium sulphate | | | | | | 12 | | | |
| Sodium carbonate | | | | | | | 8 | | |
| Acrylate/maleate copolymer | | | | | | | | 5 | 8.5 |

Calculated Final formulations (weight %) assuming no water is evaporated:

| | 1 | A | 2 | 3 | 4 | 5 | 6 | 7 | 8 |
|---|---|---|---|---|---|---|---|---|---|
| AES | 47.7 | 47.7 | 44.5 | 46.7 | 46.7 | 45.7 | 47.9 | 53.3 | 50.7 |
| Carrier | 22.7 | 22.7 | 22.7 | 23.8 | 28.6 | 22.4 | 23.2 | 19.0 | 19.3 |
| Structurant | 2.7 | 2.7 | 4.1 | 4.8 | 2.4 | 2.4 | 1.7 | 1.9 | 3.3 |
| Water | 26.8 | 26.8 | 28.6 | 24.8 | 22.4 | 29.4 | 27.3 | 25.7 | 26.7 |

Calculated final formulations (weight %) assuming all water is evaporated:

| | 1 | A | 2 | 3 | 4 | 5 | 6 | 7 | 8 |
|---|---|---|---|---|---|---|---|---|---|
| AES | 65.2 | 65.2 | 62.4 | 62.0 | 60.1 | 64.7 | 65.8 | 71.8 | 69.2 |
| Carrier | 31.1 | 31.1 | 31.8 | 31.6 | 36.8 | 31.8 | 31.8 | 25.6 | 26.4 |
| Structurant | 3.7 | 3.7 | 5.7 | 6.3 | 3.1 | 3.5 | 2.3 | 2.6 | 4.5 |

Measured properties:

| | 1 | A | 2 | 3 | 4 | 5 | 6 | 7 | 8 |
|---|---|---|---|---|---|---|---|---|---|
| Actual AES level [wt %] | 61.2 | | 61.4 | | 59.0 | 65.2 | 67.0 | 74.3 | 71.7 |
| Insolubles [wt %] | 1.2 | — | 1.0 | 0.2 | 0.2 | 1.8 | 0.3 | — | — |
| Dissolution time $t_{90}$ [sec] | 38 | — | — | 25 | — | 61 | 26 | — | — |

All resulting granular products were free flowing. The product of Comparative Example A had turned yellow upon drying, indicating that decomposition of the AES had taken place.

Examples 9 and 10, Comparative Example B

Granular Detergent Components

Granular products were prepared, using an Eirich RV02 mixer, by mixing the 70% AES paste used in previous examples with solid carrier for 10 seconds. Subsequently, structurant solution was added in the amount specified, and granulation was carried out for 5–10 seconds. In the case of Comparative Example B, no structurant solution was added.

The carrier used was Sorbosil TC-15. The structurants used were as follows:

30% glucose solution

50% citric acid solution

The granular products were dried in an Aeromatic Strea-1 fluidised bed, for 30 minutes, using an air temperature of 70° C., as in previous Examples. Compositions and properties were as shown below.

| Ingredients (g) | 9 | 10 | B |
|---|---|---|---|
| 70% AES paste | 585 | 585 | 872 |
| Sorbosil TC 15 | 315 | 315 | 328 |
| Glucose solution | 230 | | |
| Citric acid solution | | 300 | |

Calculated final formulation (weight %), assuming no water is evaporated:

| Ingredients (g) | 9 | 10 | B |
|---|---|---|---|
| AES | 36.2 | 34.1 | 50.9 |
| Silica | 27.9 | 26.3 | 27.3 |
| Structurant | 6.1 | 12.5 | 0.0 |
| Water | 29.8 | 27.1 | 21.8 |

Calculated final formulation (weight %), assuming all water is evaporated:

| Ingredients (g) | 9 | 10 | B |
|---|---|---|---|
| AES | 51.6 | 46.8 | 65.1 |
| Silica | 39.7 | 36.0 | 34.9 |
| Structurant | 8.7 | 17.2 | 0.0 |

Measured properties:

| | 9 | 19 | B |
|---|---|---|---|
| Actual AES level (analytically determined) [wt %] | 49.7 | 45.6 | — |
| Dynamic flow rate [ml/s] | 123 | 124 | 63 |

Example 11, Comparative Example C

Granular Detergent Components

Granular products were prepared on a larger scale using a Lödige 50-liter ploughshare mixer.

70% AES paste was mixed with solid carrier (Sorbosil TC15 ex Crosfield) for about 1 minute. Subsequently, structurant solution was added in 5 seconds in the amount specified, followed by granulation for approximately 10 seconds (using chopper and ploughs).

For Example 11, the structurant was 15% glucose/polyvinyl alcohol solution (glucose:PVA=20:1). In the case of Comparative Example C, no structurant solution was added.

Samples of the resulting products were dried in an Aeromatic Strea-1 fluidised bed, for 30 minutes, using an air temperature of 70° C.

Compositions and properties were as shown below.

| Ingredients (g) | 11 | C |
|---|---|---|
| 70% AES paste | 6019 | 8360 |
| Sorbosil TC 15 | 3241 | 3140 |
| Structurant solution | 2250 | |

Calculated final formulation (weight %), assuming no water is evaporated:

| | 11 | C |
|---|---|---|
| AES | 36.6 | 50.9 |
| Silica | 28.2 | 27.3 |
| Structurant | 2.9 | 0.0 |
| Water | 32.3 | 21.8 |

Calculated final formulation (weight %), assuming all water is evaporated:

| | 11 | C |
|---|---|---|
| AES | 54.1 | 65.1 |
| Silica | 41.6 | 34.9 |
| Structurant | 4.3 | 0.0 |

Measured properties:

| | 11 | C |
|---|---|---|
| Dynamic flow rate [ml/s] | 100 | 65 |

Examples 12 to 17: Detergent Compositions

To prepare full formulations containing granular detergent components according to the invention, various base powders and other granular components were produced, as follows.

Base powder F1: Spray-dried Phosphate Base

A slurry was prepared by mixing water, NaOH solution, linear alkylbenzene sulphonic acid (LAS acid), sodium tripolyphosphate (STP), sodium sulphate and sodium alkaline silicate. The slurry was spray-dried in a spray-drying tower at a rate of 1100 kg/h using an outlet air temperature of approximately 115–120° C. The resulting powder was cooled and collected. Powder F1 had the following formulation:

| Base powder F1 | wt % |
|---|---|
| STP | 28.3 |
| NaLAS | 27.8 |
| Sodium silicate | 11.0 |
| Sodium sulphate | 21.0 |
| Moisture, minors etc | 11.8 |

Base powder F2: Non-tower Phosphate Base

This powder was prepared by dosing STP, sodium carbonate and LAS acid into a Fukae FS30 granulator. The solids were pre-mixed after which the LAS acid was added and the powder was granulated using an impeller speed of 100 rpm and a chopper speed of 3000 rpm until satisfactory granules were formed. At the end of the process the granules were layered with zeolite 4A. The following formulation was formed by this process:

| Base powder F2 | wt % |
|---|---|
| STP | 45.2 |
| Zeolite (anhydr) | 2.4 |
| NaLAS | 26.7 |
| Sodium carbonate | 18.2 |
| Moisture, minors etc | 7.5 |

Builder Granule B1: Spray-dried Phosphate Granule

This was produced by spray-drying a slurry containing water, STP, NaLAS and silicate, in a spray-drying tower, at a rate of 1100 kg/h using an outlet air temperature of approximately 115–120° C. The resulting powder was cooled and collected. Builder granule B1 had the following formulation:

| Builder granule B1 | wt % |
|---|---|
| STP | 75.0 |
| NaLAS | 2.0 |
| Sodium silicate | 5.0 |
| Moisture, minors etc | 18.0 |

Builder granule B2: Non-tower Zeolite/Citrate/Polymer Granule

This was produced by continuously dosing zeolite MAP (Doucil A24 ex Crosfield), granular trisodium citrate and 40% acrylate/maleate copolymer (Sokalan CP5 ex BASF) solution into a Lödige CB30 recycler. The CB30 was operated at 1500 rpm. The exiting powder was led through a Lödige KM300 ploughshare (120 rpm), in which densification took place. The resulting powder was dried in a fluid bed. The composition of the resulting builder granule was:

| Ingredients [wt %] | B2 |
|---|---|
| Zeolite MAP (anh) | 41.6 |
| Trisodium citrate | 31.3 |
| Acrylate/maleate copolymer | 12.2 |
| Water etc. | 14.9 |

Linear Alkylbenzene Sulphonate (LAS) Granules A12 (Prepared by in-situ Non-tower Neutralisation)

These granulates were produced in a dryer/granulator from VRV SpA, Italy. LAS acid was neutralised with sodium carbonate as follows. Sodium linear alkyl benzene sulphonate particles (NaLAS) were produced by neutralising LAS acid with sodiumcarbonate. Furthermore, zeolite 4A and zeolite MAP were dosed as well. A 2 $m^2$ VRV flash-drier machine was used having three equal jacket sections. Dosing ports for liquids and powders were situated just prior to the first hot section, with mid-jacket dosing ports available in the final two sections. Zeolite MAP was also added via this port in the final section for layering purposes. An electrically-powered oil heater provided the heating to the first two jacket sections. Ambient process water at 15° C. was used for cooling the jacket in the final section. Make-up air flow through the reactor was controlled between 10 and 50 $m^3$/kg hr by opening a bypass on the exhaust vapour extraction fan. All experiments were carried out with the motor at full-speed giving a tip speed of about 30 m/s. The sodium carbonate, zeolite 4A and LAS acid were added just prior to the first hot section and zeolite MAP layering was added into the third section which was cold.

A jacket temperature of 145° C. was used in the first two sections, with an estimated throughput of components 60–100 kg/hr. A degree of neutralisation of alkylbenzene sulphonate of >95% was achieved. The granules had the following composition:

| Composition [wt %] | A12 |
|---|---|
| NaLAS | 70 |
| Zeolite 4A | 20 |
| Zeolite MAP | 5 |
| Moisture, etc | 5 |

Nonionic Surfactant Granule N1: Nonionic Surfactant on Insoluble Porous (Silica) Carrier These granules were produced using a Lödige CB30 recycler, followed by a Niro fluid bed and a Mogensen sieve.

The Lödige CB30 was operated at 1500 rpm. Water was used to cool the CB30 jacket during the process. The air flow in the Niro fluid bed was 900–1000 $m^3$/hr. The total flow of powder exiting the process was in the order of 600 kg/h. Sorbosil TC15 was continously dosed into the CB30, into which also a nonionic surfactant ($C_{12}$–$C_{15}$ alcohol with average degree of ethoxylation of 7, Synperonic A7 ex ICI) was dosed via dosing pipes. At the same time a 40% glucose solution was was dosed. This set of solid and liquid materials was mixed and granulated in the CB30 after which the resulting powder was entered in the fluid bed and treated with air which had a temperature of 80–120° C., Fines were filtered from the air stream with a cyclone and filter bags. Coarse particles (>1400 $\mu$m) were separated from the product by the Mogensen sieve.

The resulting granules had the formulations and properties shown in the table below.

| Composition [wt %] | N1 |
|---|---|
| Sorbosil TC15 | 27.7 |
| $C_{12-15}$ nonionic surfactant 7EO (Synperonic A7) | 58 |
| Glucose | 10.8 |
| Water | 3.5 |

Nonionic Surfactant Granule N2: Nonionic Surfactant on Water-soluble (Sodium Sesquicarbonate) Carrier These granules were produced as follows. In a 50-liter Lödige ploughshare mixer the following ingredients were dosed in the following proportions (weight %):

| | wt % |
|---|---|
| Sodium carbonate | 56.0 |
| Citric acid | 9.8 |
| $C_{12-15}$ nonionic surfactant 7EO (Lutensol AO7) | 22.6 |
| Water | 11.3 |

The sodium carbonate and citric acid were mixed together after which the nonionic surfactant was added. After the nonionic surfactant had been distributed well, water was added, followed by approximately 5 minutes of granulation. During the process a considerable temperature rise was observed. The resulting powder was cooled.

Full Formulations

The following full formulations (laundry detergent-powders) were produced using the AES adjunct of Example 9 (here designated E1), the granules and powders described above, and further postdosed materials, as indicated.

The total AES content of each formulation was as follows:

| | Example | | | | | |
|---|---|---|---|---|---|---|
| | 12 | 13 | 14 | 15 | 16 | 17 |
| AES level | 2 | 4 | 10 | 5 | 2.5 | 2 |

Full Formulations: "Base" Granules and Powders

| Example | 12 | 13 | 14 | 15 | 16 | 17 |
|---|---|---|---|---|---|---|
| Base powder F1 | 51.2 | | | | | |
| Base powder F2 | | | 65.7 | 65.77 | | |
| Builder granule B1 | | 26.7 | | | | |
| Builder granule B2 | | | | | 35.81 | 31.99 |
| LAS granule A12 | 11.1 | 23.5 | 10.7 | 17.8 | 8.8 | 8.8 |
| Nonionic granule N1 | | | | | 12.6 | |
| Nonionic granule N2 | | | | | | 30.3 |
| AES adjunct E1 | 4 | 8 | 20.1 | 10.1 | 5 | 4 |

Full Formulations: Postdosed Ingredients

| Example | 12 | 13 | 14 | 15 | 16 | 17 |
|---|---|---|---|---|---|---|
| Dense sodium carbonate | 17.5 | 17.5 | 1.83 | 4.66 | | |
| Sodium sulphate | 15.06 | 13.16 | | | | 7.12 |
| Sodium percarbonate | | | | | 19 | |
| TAED | | | | | 5.5 | |
| Antifoam granule | | | | | 1.7 | 1.7 |
| SCMC (80%) | | | | | 0.54 | 0.54 |
| Fluorescer granule (15%) | | | | | 1.3 | 1.3 |
| Granular sodium citrate | | | | | | 10 |
| Soil release polymer granule* | | | | | 1.5 | 1.5 |
| Polyvinyl pyrrolidone granule | | | | | 0.4 | 0.4 |
| Carbonate/silicate granules** | | | | | 5.5 | |
| EDTMP*** | | | 0.46 | 0.46 | 1 | 1 |
| Blue speckles | | | 0.2 | 0.2 | | |
| Green speckles | | | 0.2 | 0.2 | | |
| Protease Purafect 2100G | | | 0.31 | 0.31 | | |
| Savinase | 0.754 | 0.754 | | | 0.78 | 0.78 |
| Lipolase | 0.166 | 0.166 | 0.1 | 0.1 | 0.12 | 0.12 |
| Perfume | 0.22 | 0.22 | 0.4 | 0.4 | 0.45 | 0.45 |

*Sokalan (Trade Mark) HP23 ex BASF
**Nabion (Trade Mark) 15 ex Rhodia
***Dequest (Trade Mark) 2047 ex Monsanto

We claim:

1. A particulate detergent composition composed of at least two different granular components:

(a) a granular detergent component comprising:

(a1) at least 30 wt % of a heat-sensitive anionic, cationic, amphoteric or zwitterionic detergent surfactant, (a2) from 20 to 50 wt % of a water-insoluble carrier material comprising a silica or silicate having an oil absorption capacity of at least 1.0 ml/g, (a3) from 2 to 20 wt % zeolite, (a4) from 2 to 15% by weight of a structurant which is a water-soluble material capable of drying from aqueous solution and/or solidifying from a melt to form a crystalline and/or amorphous film, the structurant comprising a water-soluble film-forming material selected from the group consisting of soaps, sugars, water-soluble polymers, alkali metal silicates and combinations thereof, and (b) at least one other granular component selected from the group consisting of (b1) a detergent base powder composed of structured particles comprising anionic surfactant, builder, and optionally nonionic surfactant, (b2) a builder granule, (b3) a granule containing at least 40 wt % of alkylbenzene sulphonate and/or primary alcohol sulphate, and (b4) a granule containing at least 20 wt % of nonionic surfactant.

2. A detergent composition as claimed in claim 1, wherein the composition comprises from 2 to 50% by weight of the granular component (a) and from 50 to 98% by weight of one or more other granular components (b), the percentages being based on the total amount of granular components (a) and (b).

3. A detergent composition as claimed in claim 1, which is composed of at least three different granular components comprising surfactant and/or builder.

4. A detergent composition as claimed in claim 1, wherein the (b3) granule contains at least 60 wt % of alkylbenzene sulphonate and/or primary alcohol sulphate.

5. A detergent composition as claimed in claim 1, wherein the composition comprises from 1 to 20 wt % of alkyl ether sulphate.

6. A particulate detergent composition composed of at least two different granular components:

(a) a granular detergent component comprising:

(a1) at least 30 wt % of a heat-sensitive anionic, cationic, amphoteric or zwitterionic detergent surfactant, (a2) from 20 to 50 wt % of a water-insoluble carrier material comprising a silica or silicate having an oil absorption capacity of at least 1.0 ml/g, (a3) from 2 to 20 wt % zeolite, (a4) from 2 to 15% by weight of a structurant which is a water-soluble material capable of drying from aqueous solution and/or solidifying from a melt to form a crystalline and/or amorphous film, the structurant being selected from citric acid, sodium citrate and combinations thereof; and (b) at least one other granular component selected from the group consisting of (b1) a detergent base powder composed of structured particles comprising anionic surfactant, builder, and optionally nonionic surfactant, (b2) a builder granule, and (b3) a granule containing at least 40 wt % of alkylbenzene sulphonate and/or primary alcohol sulphate, (b4) a granule containing at least 20 wt % of nonionic surfactant.

* * * * *